FIP7811 XR 4,015,664

United States Patent [19]

Acheson et al.

[11] 4,015,664

[45] Apr. 5, 1977

[54] SHALE OIL RECOVERY PROCESS

[75] Inventors: Willard P. Acheson, Pittsburgh; Hans H. A. Huygen, Bakerstown; Robert P. Trump, Valencia, all of Pa.

[73] Assignee: Gulf Research & Development Company, Pittsburgh, Pa.

[22] Filed: Apr. 14, 1976

[21] Appl. No.: 677,040

[52] U.S. Cl. ..... 166/259; 166/245; 299/2; 299/13; 102/23

[51] Int. Cl.[2] ..... E21B 43/24; E21B 43/26

[58] Field of Search ..... 166/259, 271, 272, 256, 166/303, 299, 245; 299/2, 4, 13, 17; 102/23, 21

[56] References Cited

UNITED STATES PATENTS

| | | | |
|---|---|---|---|
| 1,913,395 | 6/1933 | Karrick | 299/2 |
| 2,970,826 | 2/1961 | Woodruff | 166/272 X |
| 3,285,335 | 11/1966 | Reistle, Jr. | 166/259 X |
| 3,303,881 | 2/1967 | Dixon | 166/247 |
| 3,316,020 | 4/1967 | Bergstrom | 166/259 X |
| 3,437,378 | 4/1969 | Smith | 166/259 X |
| 3,460,867 | 8/1969 | Cameron et al. | 299/2 |
| 3,578,080 | 5/1971 | Closmann | 166/247 X |
| 3,888,307 | 6/1975 | Closmann | 166/272 |
| 3,951,457 | 4/1976 | Redford | 299/17 X |

*Primary Examiner*—Stephen J. Novosad

[57] ABSTRACT

A method for recovering shale oil and gas from subsurface oil shale deposits in which free space is formed in the shale deposit and relieved blasting toward the free space from first shot holes drilled into the shale from the ground surface fills the free space with rubble. In-situ combustion of the rubblized shale decomposes organic material in the shale to form shale oil and gas, which are conveyed by combustion products through the shot holes to the surface, and leave a weak, easily compressible spent shale. After the in-situ combustion, shale surrounding the spent shale is rubblized by explosives detonated in second shot holes blasting toward the previously retorted zone. The second shot holes, which also are drilled from the surface into the shale, are spaced laterally from the first shot holes. The rubblized shale is then retorted by in-situ combustion. The successive rubblizing and in-situ combustion steps can be repeated to move the combustion operation laterally through the shale deposit.

9 Claims, 5 Drawing Figures

SHALE OIL RECOVERY PROCESS

BACKGROUND OF THE INVENTION

1. Field of the Invention

This invention relates to the production of shale oil and, more particularly, to a method of in-situ retorting oil shale to recover the shale oil.

2. Description of the Prior Art

The oil in oil shale is present in the form of a solid material referred to as "kerogen". To recover oil from oil shale, the shale is usually retorted at a high temperature in kiln-type equipment at the surface whereby the kerogen is decomposed into a liquid product which can be further refined to produce gasoline and other fuels. Mining and transporting the shale to the surface have been an important part of the cost of recovery of oil from shale. Oil shale is frequently found in deposits at depths below the surface of the ground large enough to preclude use of strip mining methods. Sometimes the shale deposits are very thick, for example, up to 2,000 feet and are not suitable for mining by conventional underground mining methods. If room and pillar mining, such as is used in the mining of coal, should be employed, the pillars left to support the ceiling cause a large part of the shale in the deposit to be left in place when the mining is completed.

U.S. Pat. No. 3,466,094 of Haworth et al describes a mechanical mining operation in which the shale is blasted into an underlying chamber by explosives in shot holes extending from an exposed face of the chamber. The broken shale is transported to the surface for retorting. In the process described in U.S. Pat. No. 3,537,753 of Arendt some of the costs inherent in conventional mining methods are avoided by drilling shot holes from the ground surfaces through the overburden into the shale deposit, but as in the room and pillar mining method, a substantial part of the shale is left in the formation, and it is necessary to precede the shot hole drilling with some expensive conventional mining operations.

To avoid the high cost of mechanically mining shale, attempts have been made to retort the shale in situ. In the process described in U.S. Pat. No. 1,422,204 of Hoover et al. a plurality of boreholes are drilled into the shale deposit and explosives detonated in the borehole to form fractures providing communication between the boreholes. Steam or hot combustion gases are then circulated through the cracks from one borehole to another to heat the shale to a temperature high enough to cause decomposition of the kerogen and drive volatile carbonaceous products to the surface through some of the boreholes. Oil shale has a very low permeability and the fracturing caused by detonating explosives in a borehole will not provide communication from that borehole to an adjacent borehole adequate for effective retorting of the shale. Only the shale immediately adjacent to any fracture formed by the explosion is heated and decomposed by hot gases passing through the fracture. Unless the shale is broken into small particles to form a rubble, most of the shale is bypassed and is not decomposed by the hot gases. However, if the shale subjected to the blasting is confined, conventional commercial explosives will not form a rubble of small enough pieces to permit efficient retorting. If the shale is not confined and can move when subjected to the force of the explosive, as in the blasting referred to as relieved blasting, satisfactory rubblizing can be obtained.

U.S. Pat. Nos. 3,661,423 of Garrett and 3,316,020 of Bergstrom describe processes in which the shale is broken into rubble to permit in-situ retorting of the shale and intimate contact between the hot gases used in the retorting of the broken shale. The processes of U.S. Pat. Nos. 3,661,423 and 3,316,020 require substantial room and pillar type mining operations and the drilling of horizontal holes through the shale.

In U.S. Pat. No. 3,001,776 of Van Poollen a plurality of vertical cylindrical chambers filled with rubble for retorting are formed by drilling boreholes from the surface and detonating explosives in the boreholes. The vertical chambers are separated by columns of shale which are not retorted in the process. Consequently, a substantial part of the oil in the shale deposit cannot be recovered by the process described in the patent. U.S. Pat. No. 3,465,819 of Dixon describes a process of retorting in vertical cylinders in which a chimney is formed below the shale deposit by a nuclear explosive. Conventional explosives are used to break horizontal layers of shale from the deposit and drop the thus-broken shale into the chimney where the shale is retorted. Control of the size of the chimney and rubblizing produced by nuclear explosions is difficult. Moreover, substantial amounts of unretorted shale are left in the formation between chimneys.

SUMMARY OF THE INVENTION

This invention resides in an in-situ combustion process for the recovery of shale oil from shale deposits in which shale is rubblized by relieved blasting from shot holes, drilled from the ground surfaces, into a free space in the shale deposit that provides room for the expansion of the volume occupied by the shale as it is broken into particles of a size suitable for in-situ combustion. Retorting of the rubblized shale by in-situ combustion removes organic material from the shale and thereby provides free volume. Second shot holes are drilled from the surface into the shale deposit at a location laterally spaced from the retorted area and shale is blasted from the vicinity of the second shot holes into the retorted zone. The steps of in-situ combustion and blasting are repeated to move the retorting zone laterally across the shale deposit without leaving pillars of intact shale between retorting zones.

DESCRIPTION OF PREFERRED EMBODIMENT

Figure 1:
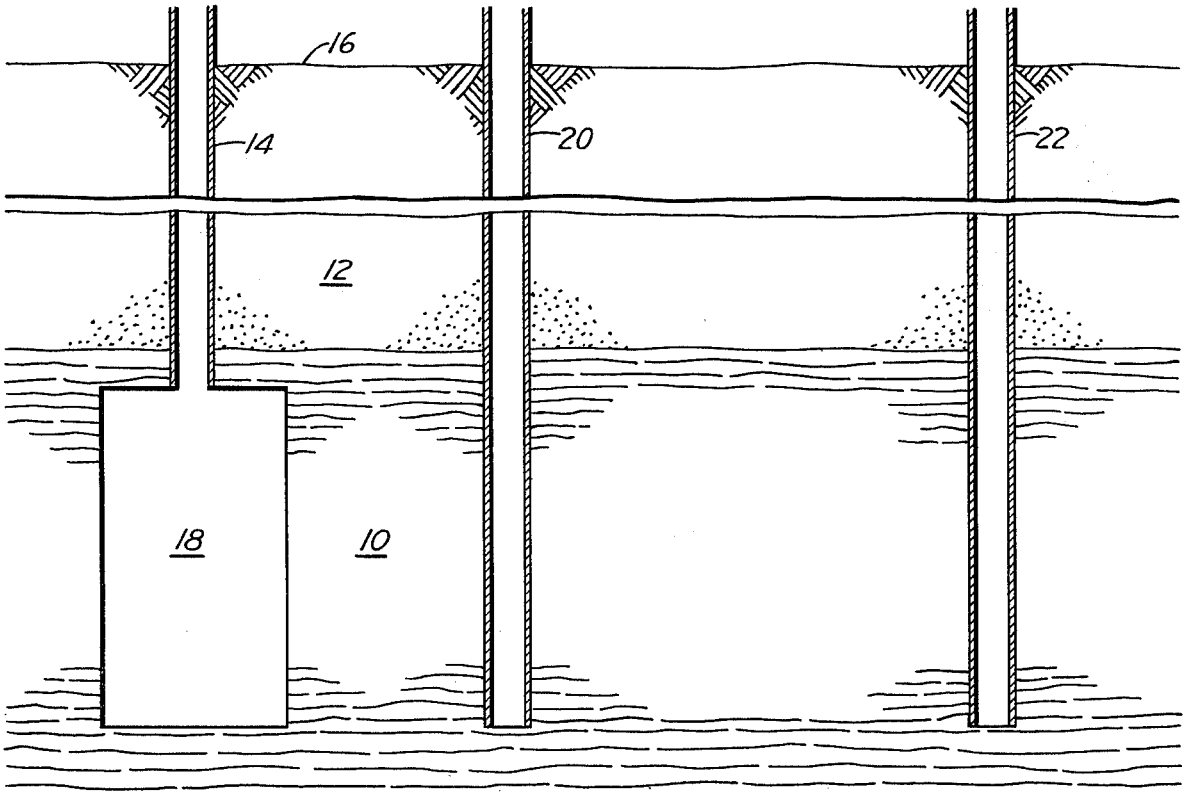
FIG. 1 is a diagrammatic view in vertical section of the pilot hole with first and second shot holes before detonation of explosives.

Referring to FIG. 1, a body of shale indicated by reference numeral 10 underlies an overburden 12. A pilot hole 14 is drilled from the ground surface 16 through the overburden and into the oil shale. In the embodiment of the invention illustrated in FIG. 1, the pilot hole 14 does not extend all of the way through the oil shale 10. Pilot hole 14 is underreamed in the interval of the oil shale 10 to form a cavity 18 of enlarged diameter relative to the diameter of the pilot hole. Underreaming can be accomplished with conventional mechanical underreamers or, in softer formations, by substantially horizontal abrasive-laden jet streams discharged at high velocities from a nozzle rotating about a vertical axis. The important factor is that no operations by men working underground are required to form the cavity. It is contemplated that the cavity 18 will have a diameter of approximately 5 feet.

First shot holes 20 are drilled from the ground surface 16 through overburden 12 into oil shale 10 at a distance from pilot hole 14 such that the expansion of the oil shale between pilot hole 14 and first shot hole 20 that occurs on the detonation of explosives in the shot holes will just fill the cavity 18. Ordinarily, the rubblizing of a shale formation will resut in a increase in volume of 5 to 20 percent. The first shot hole may, therefore, be a distance in the range of 6 to 10 feet from the pilot hole 14. Shot hole 20 can be of substantially smaller diameter than pilot hole 14 as it is not necessary to run an underreaming tool through the shot hole.

A plurality of second shot holes 22 are drilled in a ring surrounding shot holes 20 at a radial distance from pilot hole 14 such that the free space between pilot hole 14 and shot holes 20 after in-situ combustion is adequate to accommodate the expansion of the shale between shot holes 20 and shot holes 22 as that shale is rubblized. The term "free space" means the space available for expansion of shale on rubblizing; therefore, if the space is filled with spent shale, the free space is determined by the compressibility of the spent shale. It is preferred that the drilling of shot holes 22 and a plurality of third shot holes 24 located in a ring surrounding the ring of shot holes 22 and sufficient additional fourth shot holes, fifth shot holes, etc. as may be needed, spaced at increasing radial distances from the pilot hole 14 be completed before the first combustion step is initiated to allow the combustion steps of this process to be performed without interruption for drilling operations.

The amount of organic material in shales most suitable for the production of oil may range from about 20 percent of the volume of the original shale for an oil shale that yields 15 gallons of oil per ton of shale to over 40 percent of the volume of the original shale for an oil shale that yields 40 gallons of oil per ton of shale. Since the rubblizing of shale results in an increase in volume of only 5 to 20 percent, the combustion of the shale should result in a steadily increasing free space into which the rubblized shale may be moved during the rubblizing operation. Because the free volume increases as the retorting proceeds, the distance between successive rings of shot holes will change from being governed by the free space available to accommodate the rubble for the first and usually the second shot holes to being governed by the maximum thickness of shale that can be rubblized by the detonation of explosives in the shot holes. The maximum thickness of rock that can be broken into rubble of particles of a size suitable for efficient retorting is ordinarily about 10 feet, but may range up to about 15 feet. It is contemplated, therefore, that the spacing between the second and third shot holes and the subsequent rings of shot holes will usually be approximately 10 feet.

Figure 2:
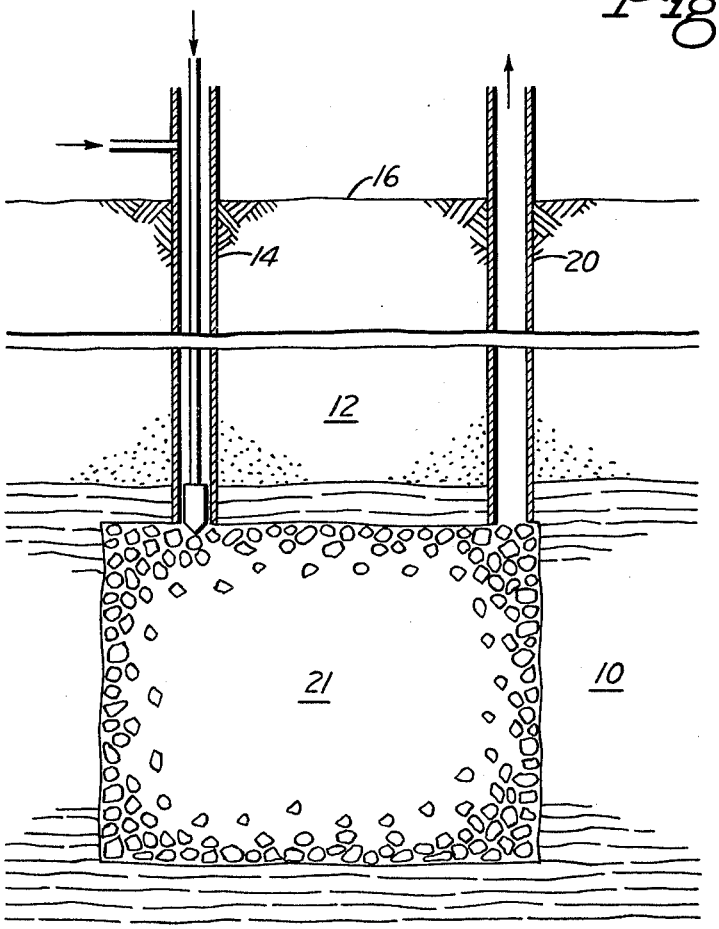
FIG. 2 is a view similar to FIG. 1 after explosives have been detonated in the first shot hole.

After the first shot holes 20 and the pilot hole 14 have been drilled, casing is preferably set in those holes to approximately the top of the bed of shale 10. Explosive is lowered into the first shot holes 20 and detonated to rubblize the shale in formation 10 between the first shot holes 20 and the cavity 18. Sequential detonation of the explosive in the shot holes 20 is preferred. The rubble is indicated in FIG. 2 by reference numeral 21. The free volume within the cavity 18 results in the shale between the cavity and the shot hole being unconfined and thereby allowing relieved blasting from the first shot holes 20. The small volume of the second shot holes 22 does not provide significant unsupported surface to allow rubblizing of shale between the first shot holes 20 and the second shot holes 22.

The pilot hole 14 is then connected for delivery of air into the formation to conduct in-situ combustion of the rubblized shale between the pilot hole and the first shot holes. A suitable burner which may be of the type described in U.S. Pat. No. 3,172,472 of Smith is lowered in the pilot hole and air and fuel are delivered to the burner and the fuel ignited to heat the shale in cavity 18 to a temperature high enough to initiate combustion. One or more of shot holes 20 are connected to suitable equipment for recovering combustion products and entrained shale oil that is carried to the surface as combustion proceeds. After ignition, the burner can be withdrawn and air injection continued until a decrease in the shale oil in the products discharged from the shot holes or a marked increase in the temperature of the products indicates that combustion of the rubblized shale has been substantially completed. The combustion operation described is a forward-burning combustion in which the movement of the combustion front is in the same direction as the flow of air and combustion products. It is highly advantageous that the combustion between the pilot hole 14 and the shot holes 20 be interrupted while the shale surrounding the shot holes is hot enough to cause spontaneous ignition of that shale on subsequent displacement of air down either the shot holes 20 or the pilot hole in the second combustion step.

Figure 3:
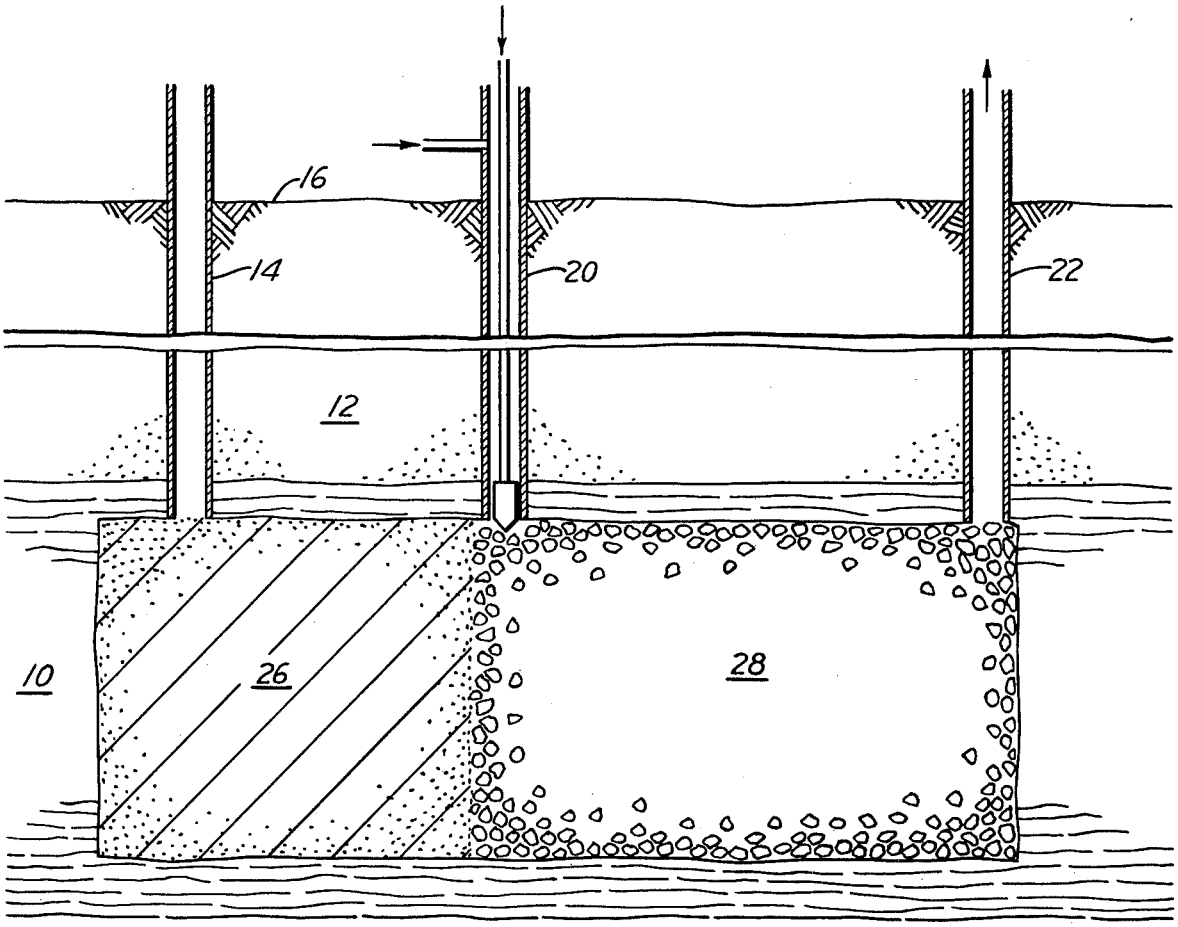
FIG. 3 is a view similar to FIG. 2 after retorting of the rubber shown in FIG. 2 and after rubblizing the shale between the first and second shot hole.
Figure 4:
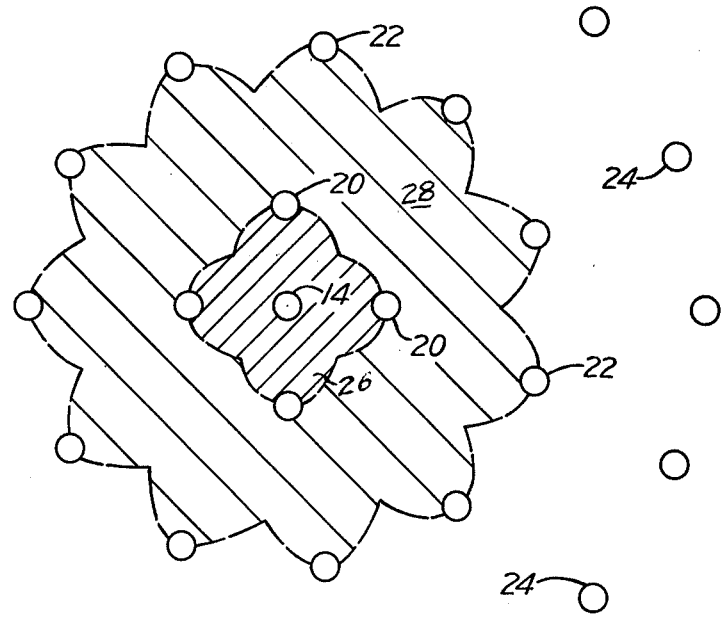
FIG. 4 is a plan view with shot holes around the pilot hole in a concentric pattern for production of shale oil.

As shown in FIG. 3, at the end of the first combustion step, rubble 21 has been converted to spent shale 26 which occupies the space between the pilot hole 14 and the first shot holes 20. Shale between the first shot holes 20 and second shot holes 22 is rubblized by explosive charges detonated in the second shot holes 22. The combustion of rubble 28 is then commenced by displacement of air either down the pilot hole or down shot holes 20 whereupon the still hot shale is ignited and shale oil and combustion products are delivered to the surface through the second shot holes 22. If spontaneous ignition of the rubblized shale 28 should not occur, a burner is lowered in shot holes 20 to heat the rubblized shale to a temperature high enough to ignite the shale as described above for the first combustion step. Combustion products and shale oil are delivered to the surface in suitable recovery equipment through second shot holes 22. The procedure can then be repeated to recover oil from the shale between the second shot holes 22 and the third shot holes 24, the third shot holes 24 and the fourth shot holes, etc.

The combustion of the shale between the pilot hole 14 and the first shot holes 20 leaves the space between those holes substantially filed with spent shale from the combustion. The removal of the organic material from the shale, however, results in an actual volume of solids substantially less than the volume of the space within the circle defined by the first shot holes. The spent shale is weak and is readily compressed by the forces resulting from the detonation of explosives in the second shot holes 22 to provide the free space necessary to accommodate the increase in volume of the shale between the first shot holes 20 and the second shot holes 22 as that shale is rubblized. The blasting that occurs on detonation of explosives in shot holes 20 is, therefore, relieved blasting.

The spacing of the shot holes will depend upon the organic content of the oil shale, the amount of expansion of the shale as it is rubblized and the fraction of the organic content of the shale that is removed during the in-situ retorting. For example, assume that cavity 18 has a radius of 2½ feet, the shale expands 10 percent on rubblizing, the shale contains 35 percent organic material and 70 percent of the organic material is removed during the retorting. The maximum distance, $R_1$, in feet from the center of the pilot hole to the first shot hole can be calculated for expansion of the shale on rubblizing to fill the free volume of cavity 18 as follows, where E = fraction shale expands on rubblizing, $R_O$ = radius in feet of cavity 18, and $R_1$ = radial distance in feet from center of pilot hole to first shot hole:

$$\Pi R_0^2 = \Pi E(R_1^2 - R_0^2)$$

$$ER_1^2 = R_0^2(1+E)$$

$$R_1^2 = [2.5^2(1.1)]/0.1 = 68.8$$

$$R_1 = 8.3$$

The free volume at the end of the first combustion step in which combustion proceeds from the pilot hole to the first shot hole is equal to the volume of cavity 18 plus the volume resulting from removal of organic material in the shale that was retorted. The free volume in cubic feet per foot of shale thickness can be expressed by the following equation in which P = fraction of shale that is organic and S = fraction of organic material decomposed:

$$\text{Free Volume} = \Pi R_0^2 + \Pi\, PS\,(R_1^2 - R_0^2)$$

$$= \Pi[6.25 + 0.35 \times 0.70\,(68.8 - 6.25)]$$

$$= 67.7$$

The radial distance from the pilot hole to the second shot hole can then be calculated as follows:

$$\text{Free Volume} = \Pi E(R_2^2 - R_1^2)$$

$$67.7 = \Pi(0.10)\,R_2^2 - \Pi(0.10)\,68.8$$

$$R_2^2 = (67.7 + 6.88\Pi)/\Pi(0.10)$$

$$R_2^2 = 284.3$$

$$R_2 = 16.8 \text{ feet}$$

The procedure can be repeated to calculate the radius $R_3$ for the third circle of shot holes. The calculations indicate that $R_3$ may be as large as 32.2 feet before the volume of rubblized shale exceeds the free volume. That makes the difference between $R_2$ and $R_3$ equal 15.4 feet, a distance that exceeds the thickness of shale that can be rubblized by the explosives. Thus, for shale having the characteristics set forth above, the spacing between the second and third shot holes and between each successive circle of shot holes is determined by the thickness of shale that can be rubblized by an explosive rather than by the free volume available to accommodate the expansion of shale on rubblizing.

Figure 5:
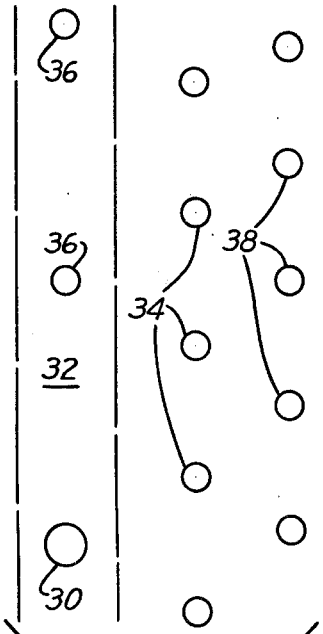
FIG. 5 is a plan view of an embodiment of the invention with a linear arrangement of the shot holes.

Referring to FIG. 5, an embodiment is illustrated in which the initial cavity is formed in the shale deposit by conventional mechanical mining methods. A shaft 30 is drilled into the shale deposit and thereafter a drift 32, the boundaries of which are shown by broken lines, is mined horizontally from shaft 30 through the shale deposit. A plurality of first shot holes 34 are drilled from the surface of the ground in a line parallel to drift 32. Shot holes 34 are spaced from the drift a distance such that the shale between the drift and the shot holes can be suitably rubblized by explosives detonated in the shot holes. In the embodiment of the invention illustrated in FIG. 5, the dimensions of the drift 32 are preferably large enough that the distance from the shot holes 34 to the drift is determined by the maximum thickness of shale that can be suitably rubblized by the explosives detonated in the shot holes. After the explosives are detonated, the shale is ignited as in the embodiment illustrated in FIGS. 1 through 4 and air delivered through the shaft 30 to cause combustion to proceed from the drift 32 to the shot holes 34. Shale oil and products of combustion are delivered from the underground deposit to the surface through the shot holes 34. It will usually be desirable to drill air supply holes 36 at intervals along the length of drift 32 from the ground surface into the drift to permit delivery of air into the drift along a substantial length of the drift. Second shot holes 38 are drilled in a line parallel to drift 32 at a distance from shot holes 34 such that shale between shot holes 38 and 34 can be suitably rubblized by explosives detonated in shot holes 38. After in-situ combustion is completed between the drift 32 and the shot holes 34, the shale between shot holes 34 and shot holes 38 is rubblized and the in-situ combustion step repeated to burn the rubblized shale between shot holes 34 and shot holes 36.

The spacing between the shot holes 34 can be increased, and consequently the number of shot holes that need to be drilled decreased, by making vertical fractures extending from the shot holes in a direction substantially parallel to the drift 32. Such fractures can be made by the method described in U.S. Pat. No. 2,699,212 of Dismukes. Thereafter, an explosive such as NCN can be pumped into the fractures and into the shot holes and detonated to blast shale into the drift 32 to accomplish the desired rubblizing of the shale. Similarly, vertical fractures can be made to extend from the shot holes 38 toward the adjacent shot holes 38 when it is desired to rubblize the shale between the shot holes 34 and the shot holes 38. Although the fractures decrease the number of shot holes that must be drilled, it will still be necessary that the distance between the drift 32 and the line of shot holes 34 does not exceed the maximum thickness of shale that can be suitably be rubblized by the explosives.

In some instances, the shale deposits have a thickness of 1,000 feet or more. To prevent excessive channeling of injected air from the pilot hole or the drift, it is preferred to conduct a series of rubblizing and in-situ combustion steps through a relatively thin layer, for example not exceeding 50 feet, of the shale deposit over the desired lateral extent of the shale deposit. The pilot hole and shot holes are then deepened and the procedure repeated through another horizontal layer.

The in-situ combustion of horizontal layers is repeated until the shale has been retorted through the desired vertical extent of the shale deposit. After the retorting of the shale has been completed, it is advantageous to flood the retorted area to remove oil adhering to the spent shale that remains in the shale deposit.

In the preferred embodiment of this invention illustrated in FIGS. 1, 2, 3 and 4, the entire shale deposit can be treated without requiring any mechanical mining steps, any underground work by men, or leaving pillars of untreated shale to provide support of the overburden. Spent shale from the combustion is left underground; consequently, support for the overburden is provided and an ash disposal facility is not needed. By drilling the shot holes into the shale from the ground surface, the economies of powerful drilling rigs are realized and the dangers of drilling and blasting by conventional mining methods avoided. In both embodiments of the invention, conventional commercial explosives such as dynamite or NCN can be used to rubblize the shale. Nuclear explosives with their attendant hazards and diminished control are avoided.

In the process of this invention, the movement of the shale that occurs on blasting is horizontal. Moreover, the shale oil and gas from the in-situ combustion of the oil shale is recovered through wells that are at the boundary of the undisturbed shale. These characteristics of the process eliminate the necessity of leaving pillars of undisturbed shale and also minimize absorption of shale oil by the spent shale.

We claim:

1. A method of producing oil from oil shale covered by overburden comprising drilling a pilot hole through the overburden and into the shale, undercutting the pilot hole through an interval in the shale and removing cuttings therefrom to form a cavity of enlarged diameter adapted to allow expansion of the shale, drilling first shot holes through the overburden and into the shale at a location spaced from the pilot hole, detonating an explosive in the first shot holes in the interval of the oil shale to blast oil shale into the cavity and thereby form a mass of rubblized oil shale between the shot hole and the pilot hole, displacing air down the pilot hole and into the oil shale, igniting the oil shale, continuing the injection of air into the pilot hole to burn shale in the cavity between the injection hole and the first shot hole, delivering oil and combustion products through the first shot holes to the surface, drilling second shot holes into the shale at a location laterally spaced from the first shot holes downwardly through the overburden and oil shale, thereafter detonating explosives in the second shot holes to rubblize oil shale into void space between the pilot hole and the first shot hole, injecting air into the rubblized shale adjacent the first shot hole, igniting the rubblized oil shale in the oil shale formation, producing oil and combustion products through a second shot hole, and repeating the series or rubblizing and in-situ combustion steps to cause combustion of the oil shale to move laterally through the oil shale.

2. A method as set forth in claim 1 in which the undercutting through an interval in the shale is accomplished by rotating a drill string extending down the pilot hole into the shale, said drill string having a mechanical underreaming tool on its lower end to enlarge the diameter of the pilot hole, and moving the underreaming tool vertically through the interval of the undercutting.

3. A method as set forth in claim 1 in which the undercutting is accomplished by discharging substantially horizontally from a nozzle mounted on the lower end of a drill string extending down the pilot hole a high-velocity stream of abrasive-laden liquid, rotating the drill string while discharging the abrasive-laden liquid from the nozzle, and moving the nozzle vertically through the interval of the undercutting.

4. A method of producing oil from oil shale covered by overburden comprising drilling a pilot hole from the surface through the overburden into the shale, forming a cavity in the shale at the lower end of the pilot hole, drilling from the ground surface through the overburden and into the shale a plurality of first shot holes spaced at substantially equal distances laterally from the pilot hole in a ring surrounding the pilot hole, detonating an explosive in the first shot holes to blast shale into the cavity, the spacing of the shot holes from the pilot hole being such that shale between the shot holes and the cavity is rubblized by the detonations, igniting the rubblized oil shale, displacing air through the pilot hole into the rubblized shale to cause in-situ combustion of the rubblized shale, delivering shale oil and combustion products through first shot holes to the ground surface, drilling second shot holes in a ring surrounding the ring of first shot holes, detonating explosives in the second shot holes to rubblize shale between the second shot holes and first shot holes, said second shot holes being spaced from the first shot holes a distance such that the detonations rubblize the shale between the first shot holes and second shot holes, igniting the rubblized shale, injecting air into the rubblized shale through the shot holes along the periphery of the previously combusted shale, delivering combustion products and shale oil through the second shot holes, and repeating the steps of drilling shot holes, rubblizing and in-situ combustion to move the in-situ combustion horizontally through the shale.

5. A method as set forth in claim 4 in which the cavity in the bottom of the pilot hole is formed by mechanical mining.

6. A method as set forth in claim 4 in which the in-situ combustion is a forward burning process.

7. A method as set forth in claim 4 in which the cavity is formed by mechanical underreaming of the pilot hole to a diameter of about 5 feet, the first shot holes are spaced 6 to 10 feet from the pilot hole, and second shot holes are spaced about 10 feet from the first shot holes, and succeeding shot holes are spaced approximately 10 feet from the immediately preceding shot holes.

8. A method of producing oil from oil shale covered by an overburden comprising drilling a pilot hole from the surface downwardly through the overburden into the shale, forming a drift extending laterally from the pilot hole through the oil shale, drilling a plurality of first shot holes through the overburden into the oil shale, said first shot holes being located on a line parallel to the drift and spaced from the drift a distance not exceeding the maximum thickness of shale that can be rubblized by explosives in the shot holes, detonating explosives in the shot holes to blast shale into the drift and form rubble between the pilot hole and the shot holes, igniting the rubblized shale, injecting air down the pilot hole into the rubblized shale to cause in-sutu combustion of the rubblized shale, delivering combustion products and shale oil through the shot holes to the surface, drilling a plurality of second shot holes, said second shot holes being located along a line parallel to the line of first shot holes spaced from the line of first shot holes a distance not exceeding the maximum thickness of shale that can be rubblized by explosives detonated in the second shot holes, detonating explosives in the second shot holes to blast shale toward the first shot holes to form a rubble between the first shot holes and second shot holes, igniting the rubblized shale between the first shot holes and the second shot holes, injecting air into the rubblized shale producing combustion products and shale oil through the second shot holes and repeating the steps of rubblizing and in-situ combustion to expand the zone of shale from which shale oil is recovered horizontally through the shale deposit.

9. A method as set forth in claim 8 in which vertical fractures are extended from the shot holes in a direction substantially parallel to the drift, explosives are displaced into the shot holes and vertical fractures, and the explosives in the shot holes and vertical fractures detonated to rubblize the shale.

* * * * *